United States Patent [19]

Machen et al.

[11] 4,305,069

[45] Dec. 8, 1981

[54] PERSONAL SMOKE AND FIRE DETECTOR AND WARNING UNIT

[76] Inventors: Robert B. Machen, 1418 S. 21 St., Arlington, Va. 22202; John E. Thompson, 1207 Briar Hollow Trail, Huntsville, Ala. 35803

[21] Appl. No.: 911,064

[22] Filed: May 31, 1978

[51] Int. Cl.[3] ..... G08B 17/10; G08B 3/00

[52] U.S. Cl. ..... 340/628; 340/629; 340/630; 116/67 R; 116/DIG. 44; 250/213 A; 250/574; 307/311

[58] Field of Search ..... 340/628, 629, 630, 400, 340/402, 634, 311; 250/574, 213 A, 389; 116/67 R, 106, DIG. 44; 307/284, 252 R, 305, 311

[56] References Cited

U.S. PATENT DOCUMENTS

| | | | |
|---|---|---|---|
| 3,496,558 | 2/1970 | Willson et al. | 340/630 |
| 3,524,986 | 8/1970 | Harnden | 307/284 |
| 3,555,532 | 1/1971 | White et al. | 340/630 |
| 3,774,044 | 11/1973 | Langeron | 340/629 |
| 3,842,259 | 10/1974 | Bruning | 250/213 A |
| 3,906,474 | 9/1975 | Lehsten | 340/629 |
| 3,980,997 | 9/1976 | Berns et al. | 340/630 |
| 4,021,792 | 5/1977 | Ludt et al. | 250/574 |
| 4,025,915 | 5/1977 | Enemark | 250/574 |
| 4,065,759 | 12/1977 | Handing | 340/630 |
| 4,088,986 | 5/1978 | Boucher | 340/634 |

*Primary Examiner*—James J. Groody

[57] ABSTRACT

This invention is a combination smoke and fire detection and alarm system that comprises a battery powered personal unit and an AC/DC sustaining unit. It provides audible and visual alarms and an emergency light. The personal unit plugs into the sustaining unit for battery charge and provides an additional smoke and fire detector when used in this mode.

3 Claims, 15 Drawing Figures

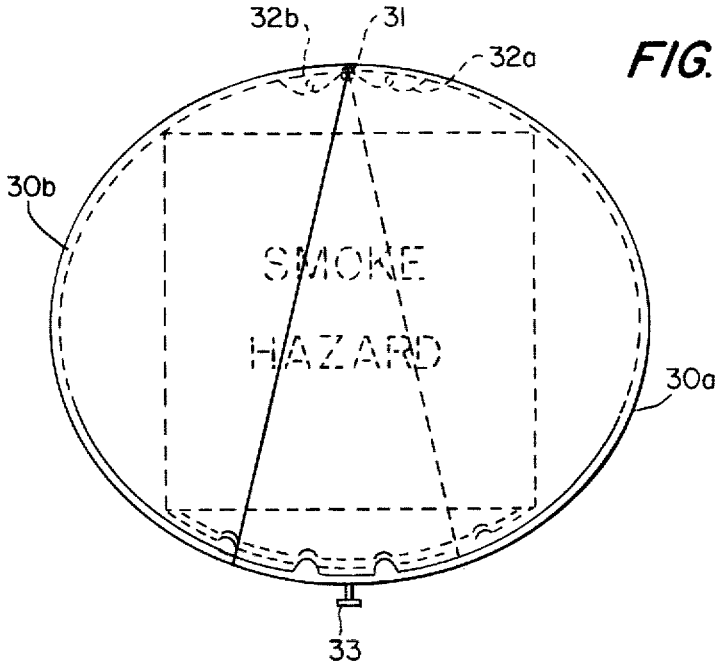
FIG. 1a
FIG. 1b
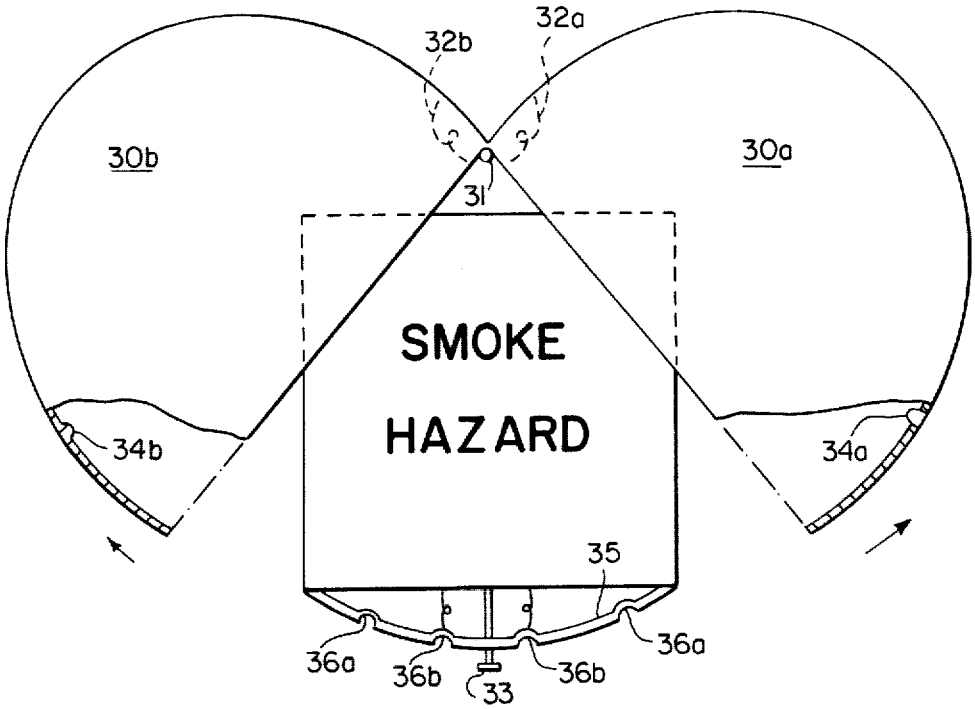

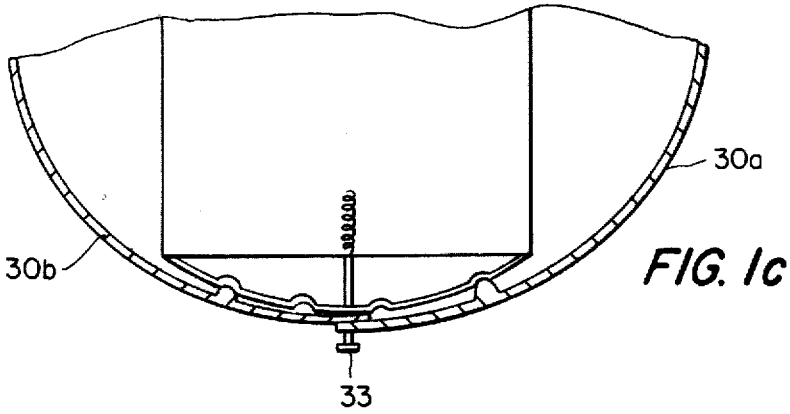
FIG. 1c
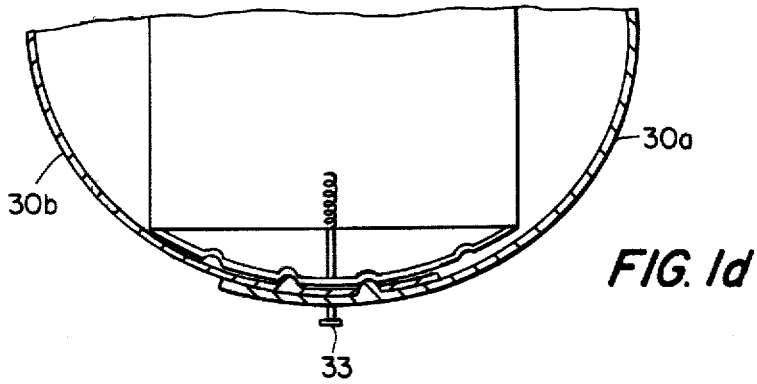
FIG. 1d
FIG. 1e
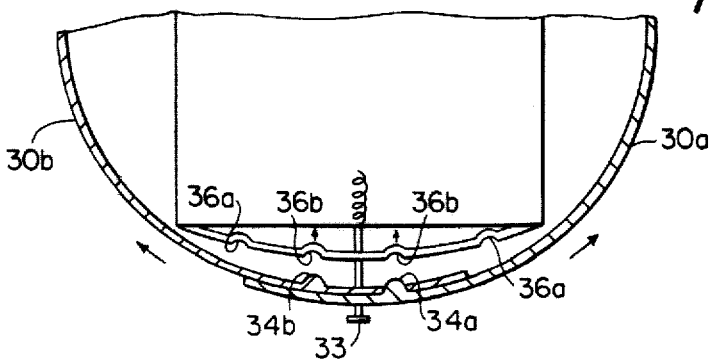

PERSONAL SMOKE AND FIRE DETECTOR AND WARNING UNIT

The present invention relates to smoke and fire detection and particularly to a reduction in size and novelty of the use, display, serviceability, and efficacy of the electronic smoke and fire detection unit and its portable recharger for flexibility of use.

The present invention is a combination smoke and fire detection and alarm system comprising (a) a battery powered personal unit comprising means for smoke and fire detection circuit using a light emitting diode, a light dependent resistor, and a light activated silicon control rectifier and means for visual and audible alarms;

(b) an AC/DC sustaining unit comprising means for smoke and fire detection through use of an ionization detector system with means for actively increasing the flow of air through the ionization chamber and means for recharging the personal and sustaining units, coupled with means for visual and continuous audible alarms and a means for converting the visual alarm to an emergency light.

In the personal unit a preferred visual alarm is spring loaded inactive and activates in the presence of smoke. Additionally, the activation of the visual alarm concurrently activates the audible alarm in the personal unit and a preferred audible alarm comprises an electronic alarm device and a trip device in sharp frictional contact with a tang. Provision is made in the sustaining unit to circulate smoke by means of a small air circulating device which enhances detection of said smoke. The sustaining unit comprises a third means for detecting and indicating the presence of smoke or fire and a means for converting the visual alarm to an emergency light for the individual who carries the device during egress from the hazardous area and provides an aural means of guiding rescuers to the scene of an incapacitated or disoriented person who may fail to depart the hazardous area.

PRIOR ART STATEMENT

The most common trait in the prior art is to devise smoke and fire detection and alarm apparatus to be secured in a location to detect the presence of a sudden fire. The fire detection and alarm systems are generally used for waking a sleeper or giving warning to a watchman of commercial or industrial facilities that a hazardous condition exists. The prior art includes ionization and electrical discharge devices. Both systems have been devised for adaptability to certain fixed locations while attempting to gain fail-safe operation where the relative humidity, strength of the light source, and other factors must be overcome for the device to be effective.

A device is needed to offer protection and warning to people who frequently change their locations or who wish to advise others that the use of smoking materials in a confined space (or area where smoke is not readily removed) tends to produce results that are offensive to the non-user. There is a need for individual protection for those who temporarily inhabit areas of unknown air quality. There is also a need for a portable device that can be battery or electrically operated while being recharged for use away from the electrical power source. The prior art devices have failed to provide a portable system incorporating more than one type of detection device and means for recharging the power source using electrical means. Previously neglected also is the provision of a combination warning device and a means of helping the warned person who, in the event of fire or smoke conditions, needs a readily accessible light source to be used in an escape maneuver.

The prior art has failed to provide any clue as to where victims might be located in the event of fire, as the main concern has been with general alarms for area inhabitants or areas more likely to become hazardous in commercial or industrial settings.

The prior art has not combined the major systems of detection as a means of providing near fail-safe operations with two mutually supporting but independent systems combined to provide constant detection capability to the individual person throughout a wide spectrum of locations and various environmental conditions. U.S. Pat. Nos. 3,774,044, 4,021,792 and 4,025,915 all lack certain essential means to provide the features necessary for a personal portable warning device.

Therefore, what is needed is a small, portable, highly sensitive warning device with unique circuitry and sufficient power to activate the device and rechargeable capability to provide a near fail-safe capability for warning the carrier and temporary occupant of certain areas of potentially hazardous or irritation conditions and a means to aid the user by providing a light source for the escape from the area by one's own capability or to lead others to one's immediate rescue in the event the person exposed is unable to egress from the hazard area due to incapacitation during darkness or lights-out conditions.

The present invention uses a detection device and amplifier, a warning release mechanism, and aural sounding device for attention getting and visual display. Miniaturization of all components is accomplished to the extent that portability and novelty are gained. The lapel-sized detector varies in size from approximately ¼ inch to 4 inches wide, ¼ inch to 2 inches thick, and ¼ inch to 6 inches long. The sizes vary for novelty, portability, and style. The pocket-sized or singleroom smoke detector and warning system will also range in sizes comparable to those sizes listed for the lapel detector. The portable charging unit with an auxiliary warning device may range in size from ¼ inch to 4 inches wide, ¼ inch to 2 inches thick, and ¼ inch to 6 inches long. The size varies to enhance pin on, pocket, purse, or suitcase carriage.

One purpose of this invention is to provide a novel attention-getting means for non-smokers to alert smokers that the concentration of smoke in assembly areas, conference rooms, or other close areas is bothersome or hazardous to the non-smoker as well as to the smoker.

The second part of the invention is to provide a portable means of smoke and fire detection where permanent or semi-permanent warning devices are not available, such as hotel or motel rooms, small apartments, recreation vehicles, trailers, vans, boats, elevators or elevator shaft areas, older buildings, waiting rooms, garages, attics, basements, meetings, club or conference rooms, and other areas of uncertain air quality that may endanger or trap the uninformed traveler or occasional visitor who cannot know if a safe or potentially unsafe condition exists. This invention provides the temporary visitor to such areas the capability to monitor the conditions to which the carrier of this detection unit is exposed. This unit provides a warning of hazardous or potentially hazardous smoke or fire condition that might be encountered in the carrier's immediate environment.

Accordingly, it is an object of this invention to provide a portable and improved method and apparatus for smoke detection.

Another object of this invention is to provide a means for generating an attention-getting device by aural means.

Yet another object of this invention is to provide a means of gaining attention to the presence of smoke or fire by a visual display.

Another object of this invention is to provide a means of providing an awareness to a person who smokes that the presence of a smoker using tobacco or other smoking materials that the odor and smoke spreads, saturates, and permeates areas surrounding the smoker or smokers.

Another object of the invention is through novelty to display to viewers who are in the presence of the carrier of the detection and alarm device that the use of tobacco or other materials for smoking may cause irritation, discomfort, distraction, and possible inefficiency.

Another object of the invention is to provide the carrier a means of warning that the area occupied has become potentially hazardous to the health and welfare of the occupants in the area surrounding the smoke source.

Another object of the invention is to provide a means by way of the sustaining unit for a portable smoke and fire detection unit to be operated by battery as well as electrical power with visual and aural warning for the traveler or person who moves about and occupies space where smoke or fire might be hazardous to the owner or user of the portable detector and warning device.

Another object of the invention is to provide a means for the smoke and fire detection device to become a source of light to be used to escape an area.

Another object of the invention is to provide a means for the smoke and fire detection device to become a locator device for rescuers to find a person in event the holder of the device becomes incapacitated during egress from a dangerous area.

The personal unit may be carried on the person, either fastened to a chain around the neck or fastened to the outer clothing by clutch fasteners, pin, or other means. The sustaining unit can be attached to the personal unit or can be used separately as a portable unit.

BRIEF DESCRIPTION OF THE DRAWINGS

FIGS. 1*a* and 1*b* show front views of a type container housing the personal smoke and fire detection unit.

FIG. 1*c* shows the latching and release mechanism parts in the non-sensing position.

FIG. 1*d* shows the latching and release mechanism in the sensing position.

FIG. 1*e* depicts the latching and release mechanism showing the function of releasing the cover.

DETAILED DESCRIPTION OF THE DRAWINGS

Figure 1F:
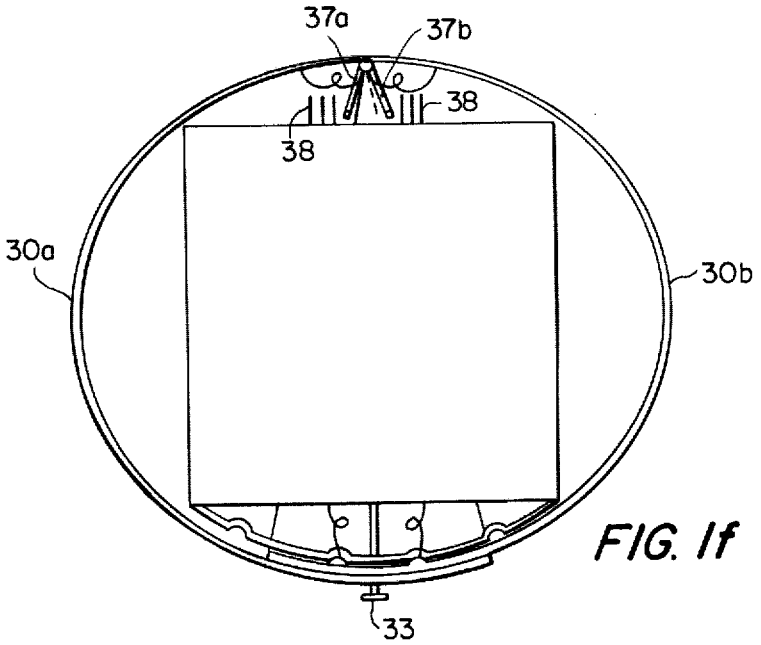
FIG. 1*f* is a closed back view of the personal smoke and fire detection unit container.
Figure 1G:
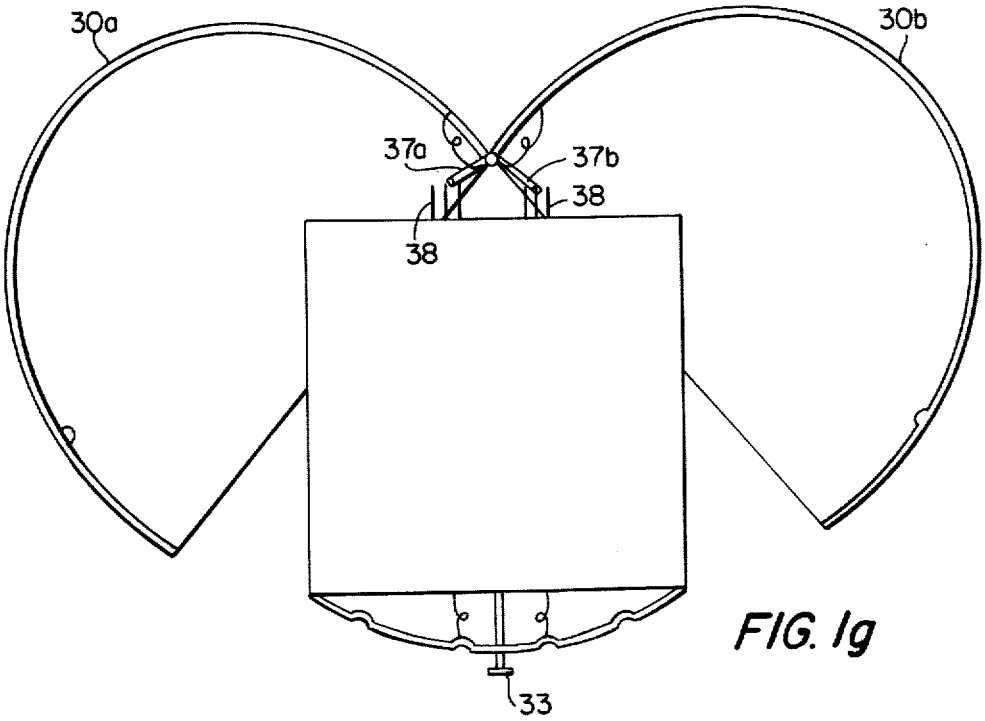
FIG. 1*g* is an open back view of the personal smoke and fire detection unit container.
Figure 1H:
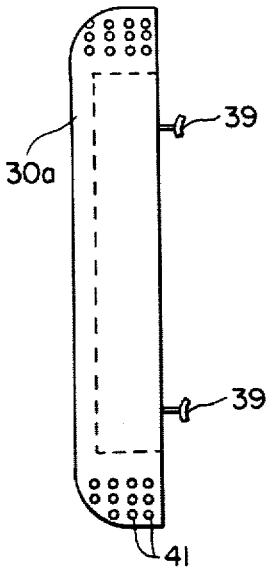
FIG. 1*h* is a side view of the personal smoke and fire detection unit container.
Figure 1I:
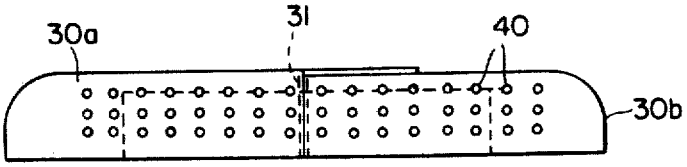
FIG. 1*i* is a top view of the personal smoke and fire detection unit container.
Figure 1J:
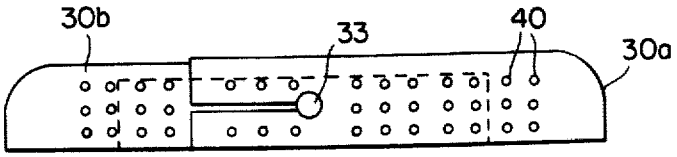
FIG. 1*j* is a bottom view of the personal smoke and fire detection unit container.
Figure 2:
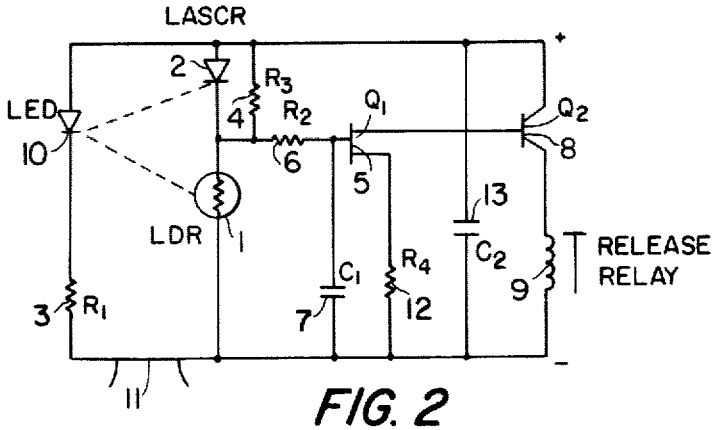
FIG. 2 shows a schematic diagram of the personal smoke and fire detection unit.

The personal detection and warning device has a split half cover 30*a*, 30*b* (FIG. 1*a*) that is hinged 31 at the top to permit each half of the cover to spring open (FIG. 1*b*) in response to the outward pressure applied to each half of the cover by springs 32*a*, 32*b* to permit opening in response to a manual release 33 or activation of the release relay mechanism 9 (FIG. 2). The split-half covers 30*a*, 30*b* have an overlap extension that contains a reinforced arm with a raised protrusion 34*a*, 34*b* near the end. The protrusions 34*a*, 34*b* are designed so that they may slide over the outer race of the flexible latching and release mechanism 35. The flexible latching and release mechanism 35 contains four detents divided into outside detents 36*a* and inside detents 36*b*. The inside detent positions 36*b* are connected by wire to the internal apparatus (FIG. 2). Insertion of the protrusions of the cover reinforcing arms 34*a*, 34*b* into the inner detent positions 36*b* energizes the system or sensing device (FIG. 2) to the ON or sensing position (FIG. 1*d*). Placing the protrusions 34*a*, 34*b*, into the outer detent position 36*a* closes the cover and obscures the "smoke hazard" visual warning and places the sensing device (FIG. 2) in the OFF or non-sensing position (FIG. 1*c*). The flexible latching and release mechanism 35 (FIG. 1*b*) may be pushed inward by pressing the manual release 33 (FIG. 1*b*), thereby removing the outward spring tension inherent in the flexible latching and release mechanism 35 (FIG. 1*b*). The relay release mechanism 9 (FIG. 2), upon being activated by the presence of smoke or fire, electrically pulls the flexible latching and release mechanism 35 inward (FIG. 1*e*) and likewise moves the detents 36*a*, 36*b* away from the protrusions on the cover reinforcing arms 34*a*, 34*b*, thereby releasing the split-half covers 30*a*, 30*b* that spring to the open position exposing the visual warning "Smoke Hazard" (FIG. 1*b*) and giving an aural warning. The aural warning is provided by an electronic alarm device 17 (FIG. 3) and the trip devices 37*a*, 37*b* (FIG. 1*f*) striking the flexible tangs 38 that are attached to the top of the sensing device and spaced to give the maximum sound level when struck by the trip devices 37*a*, 37*b* (FIG. 1*g*). The side view (FIG. 1*h*) shows the outside cover 30 with an outline view of the sensing device within. The general locations of the attaching clutch pin or clamp 39 are also shown. The top view (FIG. 1*i*) shows the cover 30*a*, 30*b* with the hinge 31 and vent holes 40. The bottom view (FIG. 1*j*) shows the manual release 33 and vent holes 40.

Figure 6:
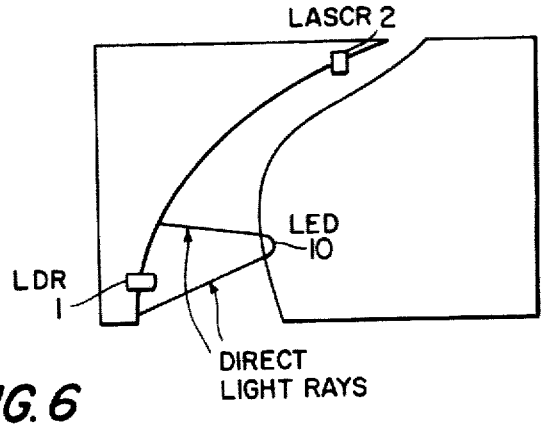
FIG. 6 shows the smoke chimney and the relational location of the light emitting diode, the light dependent resistor, and light activated silicon control rectifier.

The container covers the internal apparatus (FIG. 2) consisting of a smoke chimney 11 designed such that the smoke travels upward, interrupting the light to the Light Dependent Resistor (LDR) 1 when black smoke enters the chimney chamber, or, through reflection or refraction of light resulting from white smoke entering the chimney chamber, increases the illumination sufficient to trigger the Light Activated Silicon Control Rectifier (LASCR) 2. The arc of the smoke chimney (FIG. 6) is such that the smoke is drawn through the larger opening on the base of the detection unit and passes through the open smaller top of the chimney. Any reduction of light from the Light Emitting Diode (LED) 10 to the LDR 1 will activate the warning device. The curve of the chimney (FIG. 6) shields the LASCR 2 from the direct rays of the LED 10 or any outside source of light. The reflected or refracted light sensed by the LASCR 2 also activates the warning device. This dual mode of detection provides a means of detecting black or white smoke and provides a more sensitive means of smoke detection. The resistor ($R_1$) 3 controls the current to a safe value for the light emitting diode. The resistor ($R_3$) 4 and the LDR 1 form a voltage dividing network which sets the operating point of the field effect transistor $Q_1$ 5. Resistors ($R_2$) 6, ($R_3$) 4, and capacitor ($C_1$) 7 prevent false triggering. Resistor ($R_4$) 12 is a protective resistor which sets the operating point at $Q_1$ 5 and prevents thermal runaway. Capacitor ($C_2$) 13 is a stabilizing capacitor and supplies power during the operating of $Q_2$ 8 which draws no power until biased on by $Q_1$ 5. Static smoke entering the chimney 11 decreases the illumination to the LDR 1 causing a signal from $Q_1$ 5 to $Q_2$ 8, triggering the release mechanism 9. When the reflected or refracted light illumination is sufficient to trigger the LASCR 2, the signal from $Q_1$ 5 to $Q_2$ 8 will also trigger the release mechanism 9. The dual sensing capability provides for a more fail-safe operation. In the event the LED 10 fails, the absence of light to the LDR 1 will cause the electronic alarm device to sound. The LED 10 failure may be checked by turning the personal unit and observing the LED 10 through a viewing window when power is applied.

Figure 3:
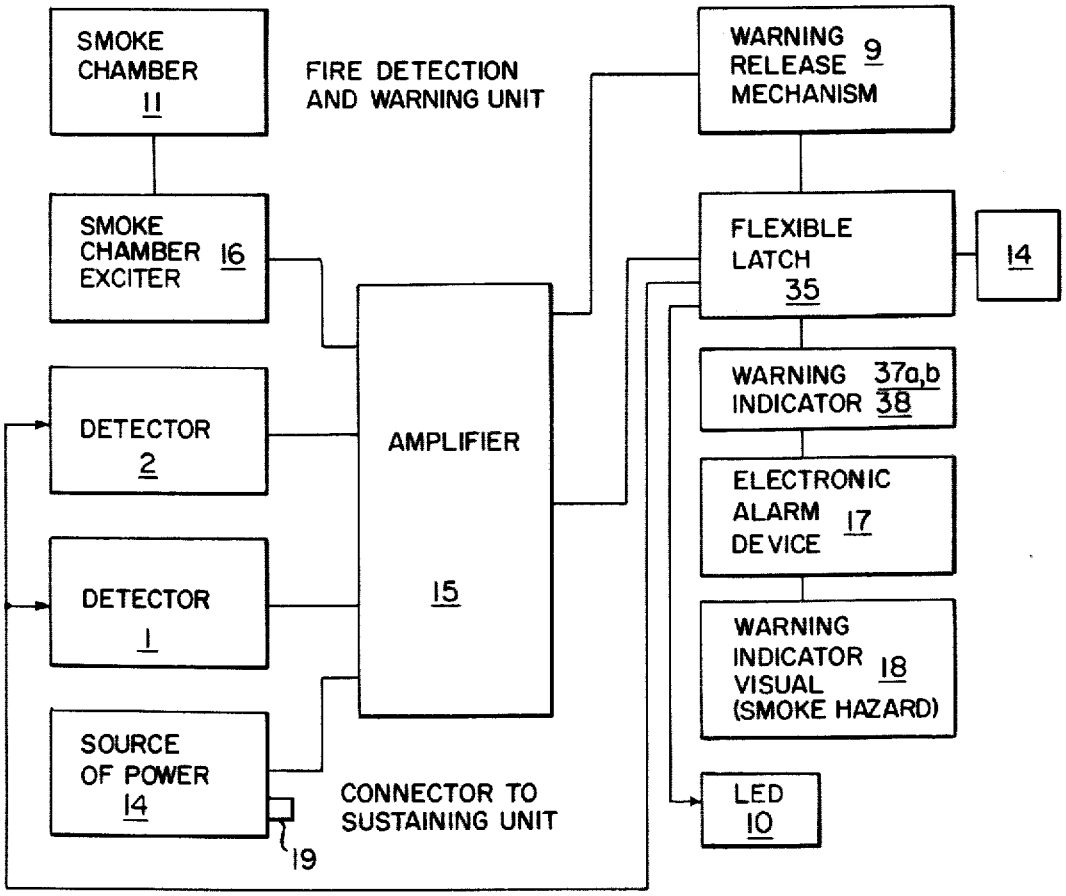
FIG. 3 shows the basic parts of the personal smoke and fire detection unit.

As noted in FIG. 3, the overall assembly is comprised of an energy source 14, amplifier 15, detector 1, detector 2, the smoke chamber exciter 16, smoke chamber chimney 11, warning release mechanism 9, flexible latch 35, warning indicator aural comprised of trip devices 37*a, b,* tangs 38, and an electronic alarm device 17, and a warning indicator visual 18. Smoke enters the chamber in the front and bottom of the unit. The change in excitation to the detectors 1, 2 results in a signal to the amplifier 15. This signal is amplified and acts on the release relay sufficiently to move the warning release mechanism 9, which moves the flexible latch 35 upward and the spring loaded cover out, exposing the visual warning 18 and producing an audible alarm 17, 37*a, b,* 38, which is caused by an electronic alarm device or the strikers hitting the flexible tangs (FIGS. 1*f* and 1*g*) attached to the cover of the sensing device.

The device uses two detectors, one excited directly through obscuration of the LDR 1 and the other, LASCR 2, receiving reflected light from the entry of smoke particles. Therefore, the unit can detect black and/or white smoke.

The flexible latch 35 also serves as the power switch. When it is depressed to the first detent (outside notches), the visual warning is concealed for convenience but power is not applied to the unit. When the warning indicator is fully depressed to the second detent (inside notches), power is applied to the LED 10, amplifier 15, and detectors 1, 2 and the release mechanism 9 can then be activated to provide warning of the presence of smoke.

Figure 4:
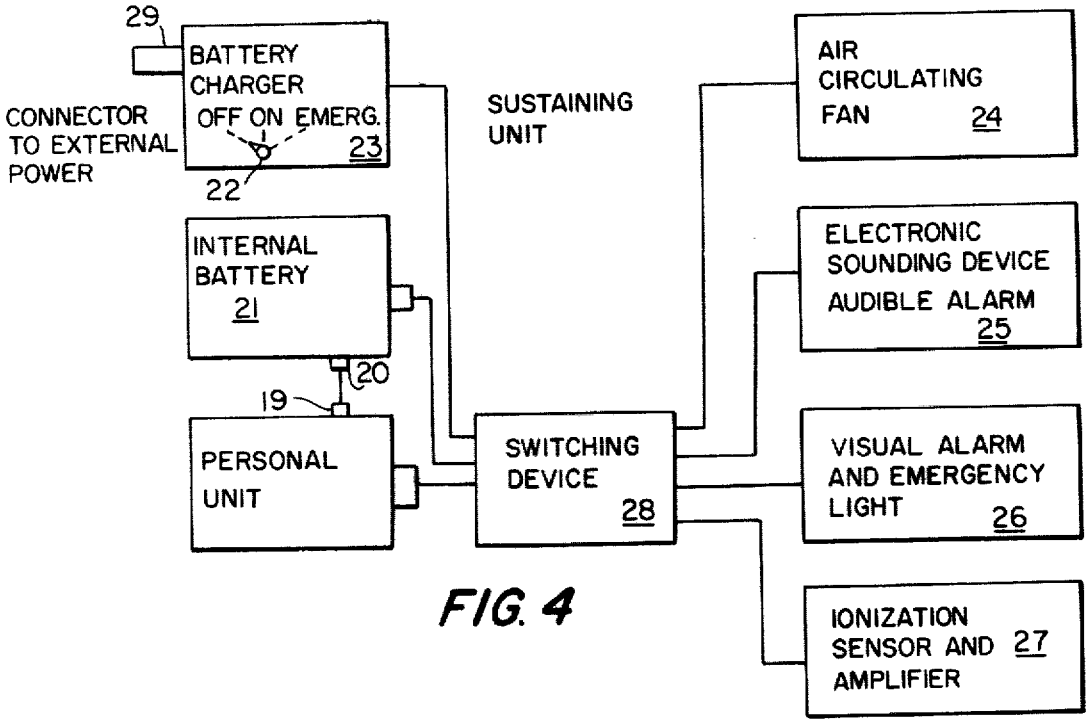
FIG. 4 shows the basic parts of the sustaining unit.
Figure 5:
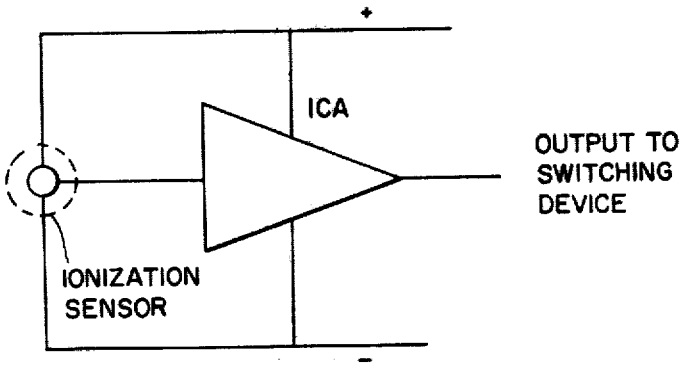
FIG. 5 shows the basic parts of the ionization sensor and amplifier.

The personal smoke and fire detection warning unit is designed to be attached through flange ducting to enhance the flow of air through both the personal and sustaining unit to increase the probability of detection of the presence of smoke and by a quick disconnect plug apparatus consisting of male plugs 19 and female plugs 20 as shown in the sustaining unit (FIG. 4). The sustaining unit comprises an energy source (battery) 21, a battery charger 23, air circulating fan 24 to enhance movement of smoke through the detecting apparatus of FIG. 3, an audible alarm electronic sounding device 25, visual alarm and emergency light 26, ionization sensor and amplifier 27 (see also FIG. 5), all of which are connected to the switching device 28. The switching device 28, upon signal from the ionization sensor amplifier 27 and/or the personal smoke and fire detection warning unit (FIG. 3), operates the audible alarm 25 and visual alarm 26. The personal warning and sustaining units are parallel; either one will operate the warning device. The visual alarm 26 (flashing light) is converted to an emergency light by placing the OFF/ON/emergency light switch 22 of the sustaining unit to the emergency light position. Power is supplied by the battery to the light source to provide illumination for the user to escape the hazard. External power is supplied through receptacle 29.

The sustaining unit operates in one of two modes: internal battery supplying the power or AC with power being supplied through the battery charger to operate the units and charge the personal unit and the sustaining unit batteries. Means are provided to correctly charge each battery.

The merit of this device is the novelty, small size, the design of the smoke chamber and location of the detectors that allow for the detection of smoke with a small personal unit. The addition of the sustaining unit provides extended detection capability for a variety of locations as the user moves from place to place. The device also provides a means for providing an available light suitable for individual use in the event light is not available through other means; i.e., when lights are out due to the nature of the hazard, such as electrical fires, storms, or explosions that eliminate electrical power when fires are started. In the event the user attempts to escape and is overcome, the continuous audible alarm will aid rescuers in their search for survivors of a smoke-filled area.

The spring-loaded cover has a trip device to come into sharp frictional contact with the attached tangs. Movement of the covering by the reaction to the release relay will cause a noise of sufficient level to be heard within a large sized room. The audible alarm of the personal and sustaining units gives off an alarm capable of being heard for 50 feet or more under normal conditions.

We claim:

1. An improvement in a combination smoke indicator and alarm comprising a rechargeable battery-powered personal unit comprising means for a visual and an audible alarm; means for smoke and fire detection that combine a light emitting diode coupled with a light dependent resistor and a light activated silicon control rectifier in a smoke chimney with power and controls to activate a mechanical alarm to give a sensitive fire and smoke detection unit capable of detecting both white and black smoke; an AC/DC sustaining unit comprising means for smoke and fire detection by an ionization sensor, means for recharging the batteries in both the personal unit and the sustaining unit, means for a visual and a continuous audible alarm and an emergency light, wherein the improvement consists of a visual alarm of said personal unit having a cover which is spring loaded inactive and becoming visible when said visual alarm of said personal unit activates in the presence of smoke.

2. The smoke indicator and alarm in the personal unit according to claim 1 wherein the activation of the cover covering said visual alarm of the personal unit concurrently activates the audible alarm of the personal unit.

3. The smoke indicator and alarm in the personal unit according to claim 1 wherein the audible alarm in the personal unit comprises a means of an electronic alarm device and a trip device means in sharp frictional contact with a tang.

* * * * *